US005199128A

United States Patent [19]

Stubbs

[11] Patent Number: 5,199,128

[45] Date of Patent: Apr. 6, 1993

[54] METHOD AND APPARATUS FOR CLEANING RUBBER DEPOSITS FROM AIRPORT RUNWAYS AND ROADWAYS

[75] Inventor: Sandy M. Stubbs, Yorktown, Va.

[73] Assignee: The United States of America as represented by the Administrator of the National Aeronautics and Space Administration, Washington, D.C.

[21] Appl. No.: 682,153

[22] Filed: Apr. 3, 1991

[51] Int. Cl.[5] ..... A47L 11/282

[52] U.S. Cl. ..... 15/52; 15/80; 15/87

[58] Field of Search ..... 15/54, 55, 80, 86, 87, 15/23, 52, 78, 79.2, 82, 21.1, 49.1, 50.1, 52; 118/112; 404/90, 122; 51/176

[56] References Cited

U.S. PATENT DOCUMENTS

| | | | |
|---|---|---|---|
| 1,178,647 | 4/1916 | Klaput | 15/78 |
| 1,224,349 | 5/1917 | Yessne | 15/82 |
| 1,247,054 | 11/1917 | Wollensak | 15/82 |
| 2,259,724 | 10/1941 | Bartholow | 15/82 |
| 2,518,183 | 8/1950 | Renne | 15/52 |
| 2,732,573 | 1/1956 | Hyland | 15/82 |
| 2,945,254 | 7/1960 | Boissonnault | 15/82 X |
| 3,709,436 | 1/1973 | Foster | 239/550 X |
| 3,726,481 | 4/1973 | Foster et al. | 239/175 X |
| 3,799,443 | 3/1974 | Foster et al. | 239/163 |
| 4,302,863 | 12/1981 | Droeser | 15/183 |
| 4,891,858 | 1/1990 | Wachter | 15/82 |
| 5,078,161 | 1/1992 | Raghavan et al. | 134/17 X |

*Primary Examiner*—Frankie L. Stinson
*Attorney, Agent, or Firm*—George F. Helfrich

[57] ABSTRACT

A method and apparatus for cleaning rubber deposits from surfaces such as airport runways and roadways is disclosed. The apparatus includes a large vehicle that has the capacity to be loaded so as to effectively add weight to rubber cleaning tires of the vehicle. In addition, the vehicle has a water tank and sprinkler system so that the surface may be wetted down in front of the tires as the vehicle proceeds across the surface. The cleaning tires of the apparatus are aligned so that they are at a yaw angle to the direction of travel, and the cleaning tire assembly is attached to the underside of the trailer of the vehicle and positioned between a forward and rear water tank. In addition this tire assembly is equipped with a means of loading the tires onto the contaminated surface.

The method comprises driving such a vehicle at low speeds down the surface as the road is being wet in front of the cleaning tires. The effect of the angled tires is to create a scrubbing action that not only heats the rubber deposits by friction but also causes it to be removed from the surface. The rubber that does not stick to the cleaning tires is then removed from the surface by sweeping.

5 Claims, 2 Drawing Sheets

METHOD AND APPARATUS FOR CLEANING RUBBER DEPOSITS FROM AIRPORT RUNWAYS AND ROADWAYS

ORIGIN OF THE INVENTION

The invention described herein was made by an employee of the U.S. Government and may be manufactured and used by or for the Government for governmental purposes without the payment of any royalties thereon or thereof.

BACKGROUND OF THE INVENTION

1. Field of the Invention

The invention is a method of and apparatus for cleaning planar vehicular surfaces of contaminants and more particularly of cleaning roadways and airport runways of rubber deposits.

2. Description of the Prior Art

Reduced traction that results from rubber deposits that accumulate on runways and roadways as a result of tire wear poses a potential danger for vehicles using such surfaces. Airport runways are a particularly bothersome problem because of the large amounts of rubber deposited due to the tire skidding during tire spin-up at the point of wheel touch down on the runway. As a result, several methods of and apparatuses for cleaning the runway of these deposits have been developed. The most common method involves blasting the contaminated surface with high pressure water using a hydraulic jetting device with varying numbers of nozzles. A similar method involves using a hydraulic jetting device to blast the contaminated surface with particulate matter with such a force so as to overcome the rubber's attraction for the surface. The last of the more common methods of cleaning the surface of contaminants involves applying a rubber removal compound to the contaminated surface followed by vigorous scrubbing until the rubber has been removed.

There are several disadvantages encountered in the previously used techniques. Using removing compounds not only is time consuming and labor intensive, but also poses problems in that the compounds that are used may have harmful effects on the environment. While the high pressure water blasting technique is ecologically safe, it still suffers from the problems of time consumption in the case of single nozzle devices and expense in the case of multiple nozzle devices. Substituting particulate matter as the removing agent does nothing to alleviate these problems.

The advantages of the present invention over the prior art are the potential for saving both time and the cost of expensive equipment. Additionally, the present invention has the potential for producing a better cleaned surface, especially when compared to rubber removing compounds.

SUMMARY OF THE INVENTION

It is an object of the present invention to provide a method of cleaning rubber deposits from a vehicular surface so as to allow maintanence of surface traction at an acceptable level.

It is a further object of the present invention to provide a method of cleaning a vehicular surface by means of a simple rolling tire passed over the wetted surface.

It is a further object of the present invention to provide a mobile apparatus for substantially cleaning rubber deposits from a vehicular surface whether flat or grooved.

It is a further object of the present invention to provide a mobile apparatus capable of substantially cleaning a vehicular surface efficiently, both in terms of time and cost.

Other objects and advantages of the invention will be apparent from the concluding portions of the specification.

According to the present invention, the foregoing and additional objects are attained by passing a weighted vehicle, with cleaning tires aligned at a yaw angle to the line of travel, over a wetted surface. A vertical force is applied to the cleaning tires of a large vehicle by means of some form of ballast that may be loaded onto the vehicle. When the tires are aligned at a yaw angle (either each turned out towards the outer frame of the vehicle or each turned in toward the center line of the vehicle) and rolled over the wetted surface, the result is a scrubbing action that effectively removes the greater part of the rubber contaminants from the surface.

BRIEF DESCRIPTION OF THE DRAWINGS

A more complete appreciation of the invention and many of the attendant advantages thereof will become more readily apparent as the same becomes better understood by reference to the following detailed description when considered in connection with the accompanying drawings wherein.

DESCRIPTION OF THE PREFERRED EMBODIMENTS

Figure 1:
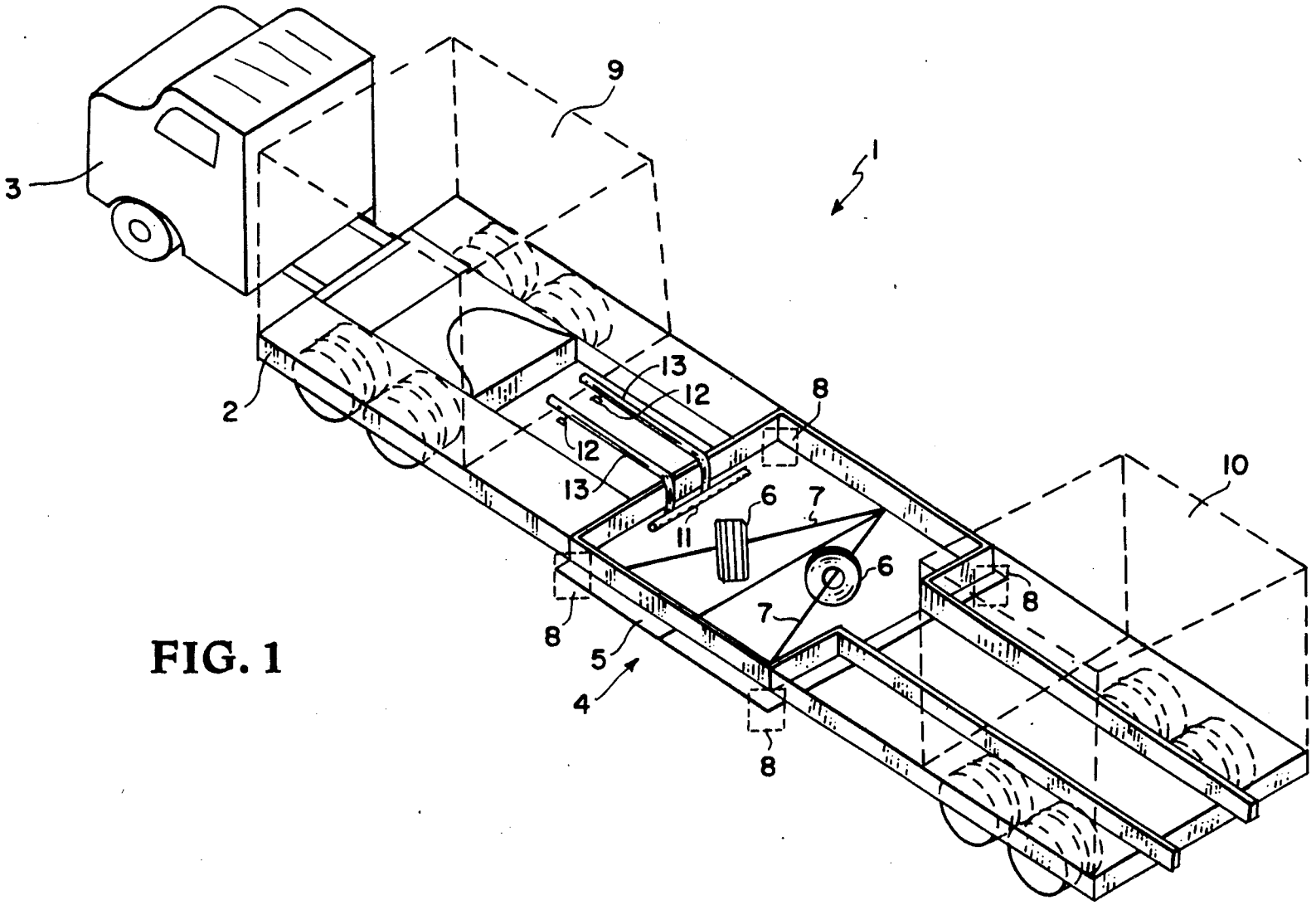
FIG. 1 illustrates an overview of the cleaning apparatus of the present invention.
Figure 2:
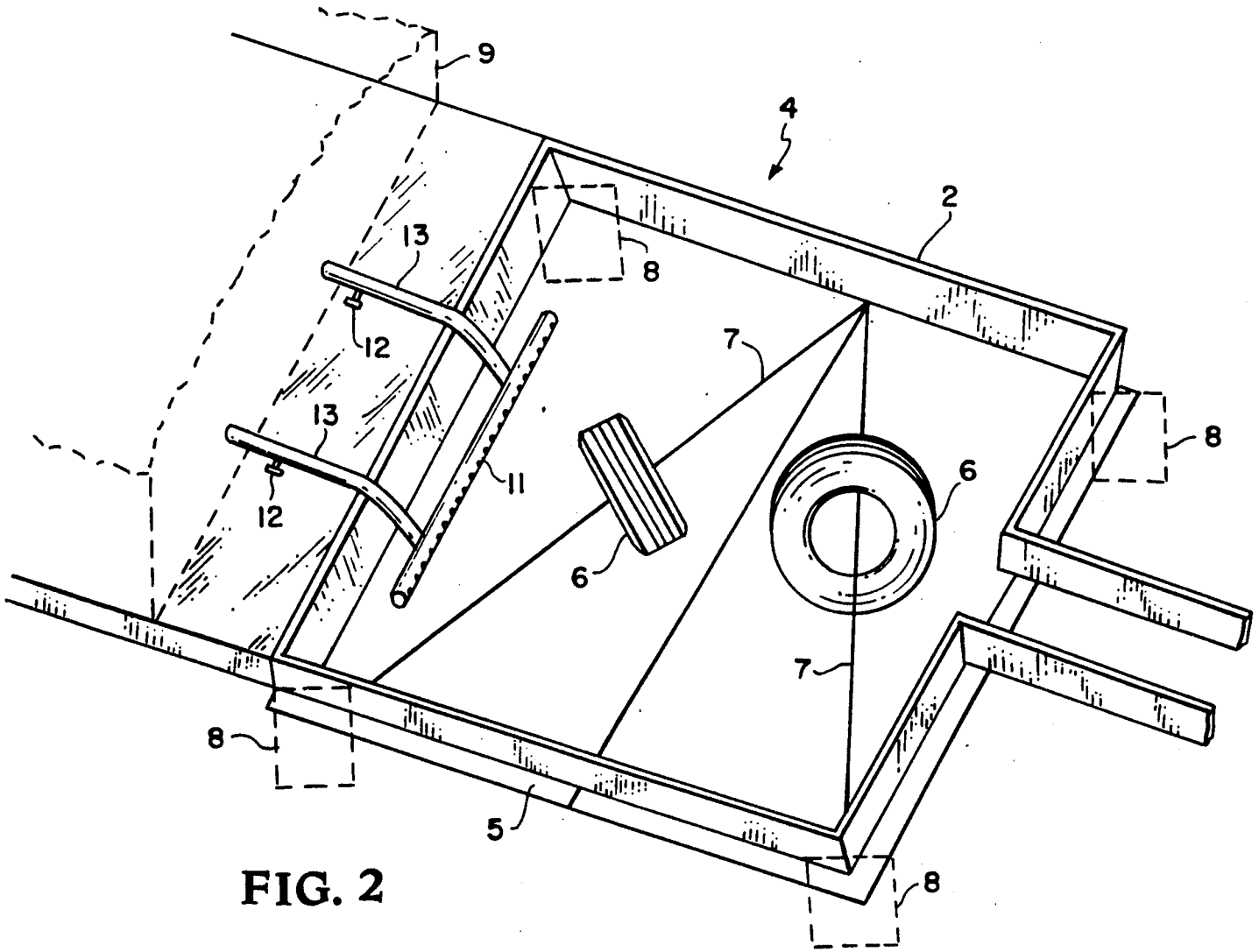
FIG. 2 illustrates an overhead view of the cleaning tire assembly and the road wetting system.

Referring to the drawing, a preferred embodiment of an apparatus for cleaning rubber deposits from a roadway or airport runway is represented by FIG. 1. The apparatus is fully contained in a large vehicle 1 similar to a tractor trailer truck. The vehicle is equipped with a retractable rubber tire assembly 4 attached to the underside of the trailer 2 that follows the cab 3 of the vehicle as seen in FIG. 2. This tire assembly 4 is located between the front 9 and rear 10 water tanks that are mounted on the top of the trailer 2. The tires 6 are attached to axles 7 that are in turn attached to a frame 5 that may be raised or lowered so as to make it possible to place the tires 6 in contact with the surface during cleaning and then raise them off the surface when the cleaning procedure is over. This frame 5 is then attached to the underside of the trailer 2.

The retraction of the tire assembly 4 may be accomplished in any number of ways. The means 8 of raising and lowering the tires 6 may be a pulley system operated either manually or by an electric or gas powered motor. Further, the tires 6 may be retracted by means of a jack that is placed under the cleaning tire assembly 4. Alternatively, the tire assembly 4 may be worked by means of a lever system that may be raised and lowered and locked in the various positions that are needed to properly operate the apparatus. In the preferred embodiment, these tires 6 are raised and lowered by a hydraulic lift system. This mode is not only more efficient but it is also easier and more practical in that it requires a minimum of physical effort on the part of the operator and thus can be accomplished by a single person.

The cleaning tires 6 of this assembly 4 are aligned in such a way as to place them at a yaw angle to the direction of travel. Either both of the tires 6 are turned in toward the center line of the vehicle 1 or both of the tires are turned out toward the outer frame of the vehicle 1. In this way the vehicle 1 is able to be maintained in a straight line as it passes over the surface being cleaned as each of the angled tires 6 serves to cancel the sideward pulling effect of the other tire 6. In the preferred embodiment this yaw angle is approximately 9°.

Water tanks 9, 10 are attached on top of the trailer both in front of the tire assembly 4 and behind it. Both the front 9 and rear 10 tanks are filled with water and used for ballast to place a vertical force on the cleaning tires 6. In the preferred embodiment this load is equal to a weight that supplies approximately 27,000 pounds of vertical force per cleaning tire. As a result, in the preferred embodiment, the total weight of the water contained in both tanks, when added to the weight of the trailer, is approximately 70,000 pounds. In addition the front tank 10 is also used to supply water to wet the road directly in front of the cleaning tires. To accomplish this wetting procedure this front tank is equipped with a valve 12 that controls the flow of water through a pipe 13 that is in turn attached to a horizontally mounted pipe 11 that has a series of holes to allow the water to be dispersed evenly over the surface just in front of the cleaning tires 6. While this system need only be a simple series of PVC piping, any system that delivers a controlled amount of water to the surface just in front of the cleaning tires 6 will be effective. The amount of water dispensed need only be enough to wet the surface as it would be wet by rain (approximately 0.03 inches).

The method for cleaning rubber deposits off of runways, in its simplest form, involves rolling a tire or tires, positioned at a yaw angle to the direction of travel and weighted with a vertical load, over a wet surface at a low rate of speed. The result is to produce a scrubbing action that creates heat due to the friction of the tire passing over the surface. This scrubbing, when coupled with the heating effect, then causes the rubber deposits to be removed from the surface. In its preferred embodiment, the method utilizes the apparatus described above and thus obtains the benefit of more than one tire being used for cleaning. While not limited to the above described apparatus, the method in its preferred embodiment uses such a vehicle which ideally travels at approximately five miles per hour and exerts approximately 27,000 pounds of vertical force per tire, with the cleaning tire or tires positioned at a 9° yaw angle to the line of travel. After the vehicle has been passed over the contaminated area, much of the rubber has adhered to the tires and need only be peeled off. However, some of the rubber may still need to be picked up or swept off the runway and collected by hand. Additionally, if the surface is heavily contaminated, more than one pass of the vehicle over the surface is necessary in order to achieve the desired results.

This method of removing rubber contaminants is used on a fairly wide range of planar surfaces. In particular, the method is effective when used on planar concrete vehicular surfaces and planar asphalt surfaces. Additionally, this method is effective in removing rubber deposits from grooved surfaces as well as flat surfaces.

What is claimed is:

1. An apparatus for removing rubber deposits from a surface comprising:

a large vehicle having a cab, a trailer following the cab, and a cleaning assembly attached to the under side of said trailer, including:

a frame directly attached to said trailer, at least one axle attached to said frame, and at least one tire mounted on said axle so that said axle and said tire are aligned at a yaw angle to the direction of travel of the vehicle;

a means for raising and lowering said cleaning assembly for contact of said tire with said surface;

at least one water tank attached to the top side of said trailer, said water tank being equipped with a means for delivering a desired amount of water to said surface in front of said tire with respect to the direction of travel of the vehicle; and a means for placing a vertical load on said tire.

2. The apparatus of claim 1, wherein the tire is a rubber tire.

3. The apparatus of claim 2, wherein said trailer is equipped with a forward water tank and a rear water tank attached to the topside of said trailer, said forward water tank and rear water tank being positioned so as to provide said vertical force on the rubber tire, said forward water tank being equipped with the water delivery means;

and wherein said cleaning assembly is located between said forward and rear water tanks.

4. The apparatus of claim 3 wherein said means for raising and lowering said cleaning assembly is a hydraulic lift means.

5. The apparatus of claim 3 wherein said vertical force is about 27,000 pounds per tire;

and wherein said yaw angle is about 9°.

* * * * *